US009072382B2

(12) United States Patent
Johansson

(10) Patent No.: US 9,072,382 B2
(45) Date of Patent: Jul. 7, 2015

(54) PORTABLE AND COLLAPSIBLE CHAIR

(71) Applicant: Bruce R Johansson, Chanhassen, MN (US)

(72) Inventor: Bruce R Johansson, Chanhassen, MN (US)

( * ) Notice: Subject to any disclaimer, the term of this patent is extended or adjusted under 35 U.S.C. 154(b) by 0 days.

(21) Appl. No.: 13/802,993

(22) Filed: Mar. 14, 2013

(65) Prior Publication Data

US 2014/0265465 A1 Sep. 18, 2014

(51) Int. Cl.

| | |
|---|---|
| ***A47C 7/62*** | (2006.01) |
| ***A47C 4/02*** | (2006.01) |
| ***A47C 4/03*** | (2006.01) |

(52) U.S. Cl.

CPC . *A47C 4/021* (2013.01); *A47C 4/03* (2013.01); *A47C 7/62* (2013.01)

(58) Field of Classification Search

CPC ..... A01K 97/22; A47C 9/10; A47C 4/021; A47C 4/03; A47C 7/62

USPC ..... 297/188.01, 188.08, 188.09, 188.2, 297/440.1, 440.13, 440.15

See application file for complete search history.

(56) References Cited

U.S. PATENT DOCUMENTS

| | | | | | |
|---|---|---|---|---|---|
| 3,114,574 | A | * | 12/1963 | Pryale | 312/235.2 |
| 4,295,680 | A | * | 10/1981 | Grasso | 297/188.09 |
| 4,436,340 | A | * | 3/1984 | Hernandez | 297/188.09 |
| 4,907,840 | A | * | 3/1990 | Hawkins | 297/188.09 |
| D364,747 | S | * | 12/1995 | Schuppel et al. | D6/368 |
| 5,692,335 | A | * | 12/1997 | Magnuson | 43/54.1 |
| 5,938,276 | A | * | 8/1999 | Munoz et al. | 297/188.12 |
| 6,619,749 | B2 | * | 9/2003 | Willy | 297/440.13 |
| 7,055,907 | B1 | * | 6/2006 | Tilby | 297/380 |
| 7,341,314 | B1 | * | 3/2008 | Boyd | 297/467 |

* cited by examiner

*Primary Examiner* — Philip Gabler

(74) *Attorney, Agent, or Firm* — Geiser Law, PLLC; Greg N. Geiser

(57) ABSTRACT

A collapsible and portable chair for storage in a container. The chair includes two separate components: a seat portion and back portion. The back portion is received within an aperture of seat portion and supported by a collar. The back portion and the seat portion are connected with a tether and sized to be placed within a standard bucket during storage and for placement on the top of the bucket during use.

4 Claims, 2 Drawing Sheets

PORTABLE AND COLLAPSIBLE CHAIR

CROSS REFERENCE TO RELATED APPLICATIONS

Not Applicable.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention relates to an improved portable chair for receipt within a container.

Often when working or viewing an individual desires a place to sit to make the task or viewing more comfortable and enjoyable. Frequently, a user will bring along some sort of seating device or chair. Often these chairs have soft back and are not conveniently carried. Further, it is known individuals often utilize five gallon buckets or other similar containers in doing various tasks around the house or in the yard. It is desired that a chair with a rigid back be incorporated within this bucket to utilize an existing common structure and make tasks and viewing more enjoyable and comfortable. Therefore, a portable chair with a rigid back for storage within a bucket and use on the top of the bucket is desired. Preferably, this chair is easily carried and able to be used for multiple tasks.

SUMMARY OF THE INVENTION

In a portable and collapsible chair embodying the principles of the invention, the chair includes two separate components: a seat portion and a rigid back portion. The components are connected with a tether and designed for receipt within a container. Preferably, the container is a standard five-gallon bucket. A five-gallon bucket is preferred as it is readily available and often used with handy-man type activities that are improved by sitting.

The seat portion is planar and rigid with a width and having a top side, a bottom side, a first end, and a second end. The first end includes an aperture extending along the width of the seat portion. A collar having a height extending upward from the top side surrounds the aperture. Preferably the height of the collar is ¾ of an inch. The second end includes a notch extending from the top side to the bottom side. The notch is centrally located along the width of the second end. A peg is located on the bottom side of the second end adjacent the notch. The peg has a height and extends outward from the bottom side in a direction opposite the collar. Preferably, the peg has a height of ¼ of an inch.

The back portion is planar and rigid with a tapered width having a wide end and narrow end. The narrow end having a notch centrally located along the width of the narrow end. The narrow end is sized for receipt within the aperture of the seat portion, wherein the narrow end protrudes into and through the aperture and is frictionally retained within the aperture by the collar and the width of its tapered shape. The wide end of the back portion has an aperture centrally located along the width and sized to receive the peg.

A tether is connected to the wide end of the back portion and the first end of the seat portion. The tether can be received within a small hole of the components and retained by a knot. The tether is used to secure the components together and function as a carrying strap. Preferably, the tether is four (4) feet long.

The back portion and the seat portion are used in two positions, a storage position and an assembled position. In the storage position, the back portion and the seat portion are stacked with the tether wrapped around the stacked portions. In the storage position, the back portion is placed on the bottom side of the top portion with the peg orientated for receipt in the aperture of the back portion. In this position the pair of notches are aligned opposite each other and receive the tether, wherein the notches prevent slippage of the tether and retain the tether in a wrapped position.

In the assembled position the back portion narrow end is inserted into the aperture of the seat portion through the collar. The back portion is then frictionally retained within the aperture by the collar and the tapered shape of the back portion. The collar further adds support to the structure and ensures the connection is retained during use. The protrusion of the back portion through the aperture and the peg provide stability to the chair when it is placed in the opening of a standard five gallon bucket.

Preferably, the portions are sized for receipt within a standard five gallon bucket, allowing for easy transport of the device. Although it is preferred that the unassembled portions fit entirely within the bucket, it is anticipated that additional sizes may be constructed. These sizes, while maintaining a width to fit within a circumference of the bucket, may protrude from the height of the bucket, wherein they may still be placed within a bucket but not enclosed by a lid or cover.

In the use, the chair can be carried and used in multiple configurations. In one configuration the chair is carried by slinging the back portion and seat portion connected by the tether over the shoulder of the user. In a second configuration the chair is stacked and placed into a bucket for transport. In use the chair may be assembled and placed onto the open top of bucket for use. The assembled portions may also be used on flat or uneven surfaces on the ground to provide support. The chair may be assembled and positioned upside down to be used as a head rest in a prone position. The separate chair portions may also be used as a solid surface for writing, drawing, eating, or any use requiring a rigid and strong surface.

BRIEF DESCRIPTION OF THE SEVERAL VIEWS OF THE DRAWING(S)

The accompanying drawings are included to provide a further understanding of the present invention and are incorporated in and constitute a part of this specification. The drawings illustrate exemplary embodiments of the present invention and together with the description serve to further explain the principles of the invention. Other aspects of the invention and the advantages of the invention will be better appreciated as they become better understood by reference to the Detailed Description when considered in conjunction with accompanying drawings, and wherein.

DETAILED DESCRIPTION OF THE INVENTION

Figure 1:
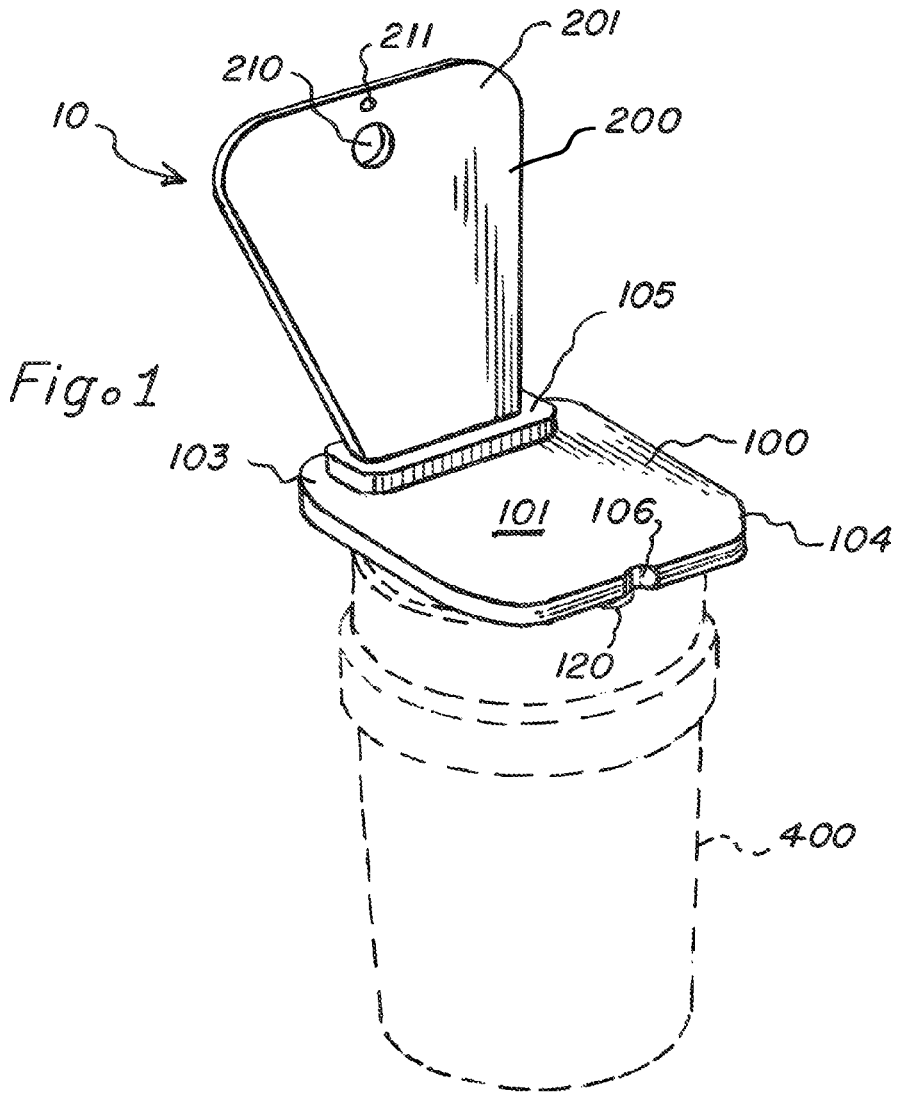
FIG. 1 is an isometric view of a collapsible and portable chair, according to the present invention.
Figure 2:
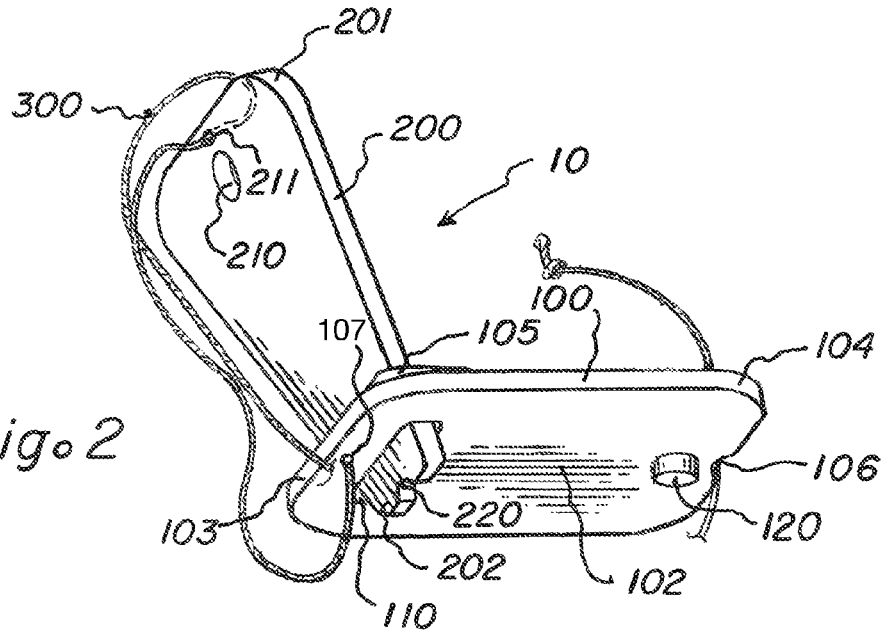
FIG. 2 is an isometric view of the underside of the collapsible and portable chair, according to the present invention.

Referring now to FIGS. 1-3C, of a portable and collapsible chair, generally referred to as 10, the chair 10 includes two separate components: a seat portion 100 and a rigid back portion 200. The seat portion 100 and back portion 200 are connected with a tether 300 and designed for receipt within a container 400. Preferably, the container 400 is a standard five-gallon bucket. A five-gallon bucket is preferred as it is readily available and often used with handy-man type activities that are improved by sitting.

The seat portion 100 is planar and rigid with a width and having a top side 101, a bottom side 102, a first end 103, and a second end 104. The first end 103 includes an aperture 110 extending along the width of the seat portion 100. A collar 105 having a height extending upward from the top side 101 surrounds the aperture 110. Preferably the height of the collar 105 is ¾ of an inch. The second end 104 includes a notch 106 extending from the top side 101 to the bottom side 102. The notch 106 is centrally located along the width of the second end 104. A peg 120 is located on the bottom side 102 of the second end 104 adjacent the notch 106. The peg 120 has a height and extends outward from the bottom side 102 in a direction opposite the collar 105. Preferably, the peg 120 has a height of ¾ of an inch. A hole 107 may be placed on seat portion 100 to retain the tether 300 to the seat portion.

The back portion 200 is planar and rigid with a tapered width having a wide end 201 and narrow end 202. The narrow end 202 having a notch 220 centrally located along the width of the narrow end 202. The narrow end 202 is sized for receipt within the aperture 110 of the seat portion 100, wherein the narrow end 202 protrudes into and through the aperture 110 and is frictionally retained within the aperture 110 by the collar 105 and the width of its tapered shape. The wide end 201 of the back portion 200 has an aperture 210 centrally located along the width and sized to receive the peg 120.

A tether 300 is connected to the wide end 201 of the back portion 200 and the first end 103 of the seat portion 200. The tether 300 can be received within a small hole 211 of the components and retained by a knot. The tether 300 is used to secure the components together and function as a carrying strap. Preferably, the tether 300 is four (4) feet long.

Figure 3A:
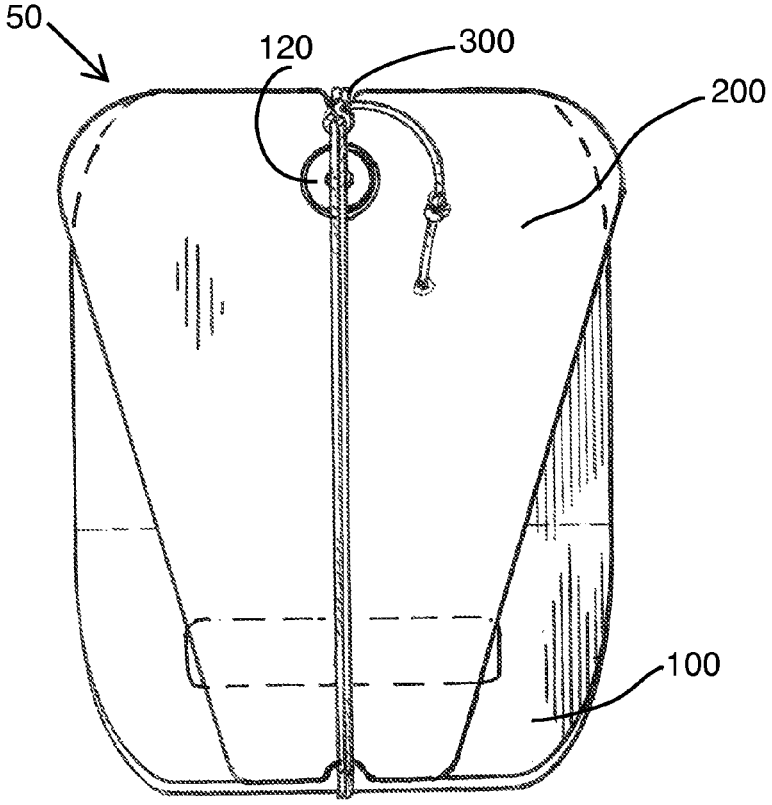
FIG. 3A is a top view of the collapsible and portable chair in its stored position, according to the present invention.
Figure 3B:
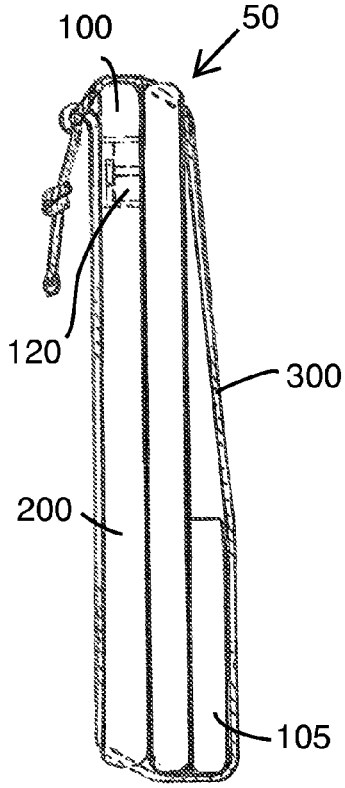
FIG. 3B is a side view of the collapsible and portable chair in its stored position, according to the present invention.
Figure 3C:
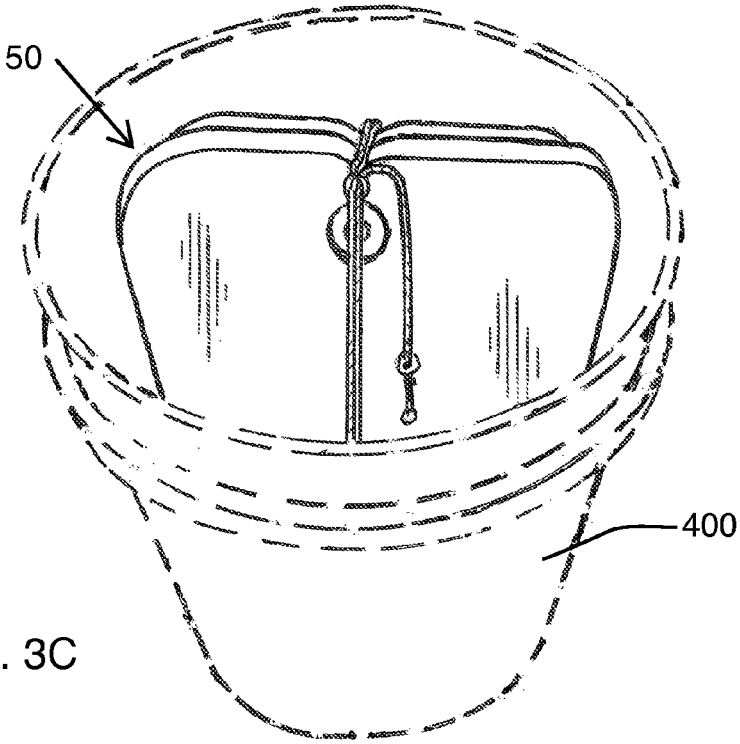
FIG. 3C is a isometric view of the collapsible and portable chair in its stored position within a container, according to the present invention.

The back portion 200 and the seat portion 100 are used in two positions, a storage position 50 (as seen in FIGS. 3A, B, C) and an assembled position (as seen in FIG. 1). In the storage position 50, the back portion 200 and the seat portion 100 are stacked with the tether 300 wrapped around the stacked portions. In the storage position 50, the back portion 200 is placed on the bottom side 102 of the top portion 101 with the peg 120 orientated for receipt within the aperture 210 of the back portion 200. In this position the pair of notches 106 and 220 are aligned opposite each other and receive the tether 300, wherein the notches 106 and 220 prevent slippage of the tether 300 and retain the tether 300 in a wrapped position.

In the assembled position, the back portion 200 narrow end 202 is inserted into the aperture 110 of the seat portion 100 through the collar 105. The back portion 200 is then frictionally retained within the aperture 110 by the collar 105 and the tapered shape of the back portion 200. The width of the aperture 110 allows for some lateral reclining movement of the back portion 200 while retained within the aperture 110. Based upon experimentation and use the preferred width of the aperture 110 is approximately ⅞ of an inch. The collar 105 further adds support to the structure and ensures the connection is retained during use. The protrusion of the back portion 200 through the aperture 110 and the peg 120 provide stability to the chair 10 when it is placed in the opening of a standard five gallon bucket.

Preferably, the portions are sized for receipt within a standard five gallon bucket, allowing for easy transport of the chair 10. Although it is preferred that the unassembled portions fit entirely within the bucket, it is anticipated that additional sizes may be constructed. These sizes, while maintaining a width to fit within a circumference of the bucket, may protrude from the height of the bucket, wherein they may still be placed within a bucket but not enclosed by a lid or cover.

In the use the chair 10 can be carried and used in multiple configurations. In one configuration the chair 10 is carried by slinging the back portion 200 and seat portion 100 connected by the tether 300 over the shoulder of the user. In a second configuration, the chair 10 is stacked and placed into a bucket for transport. In use, the chair 10 may be assembled and placed onto the open top of bucket for use. The assembled portions may also be used on flat or uneven surfaces on the ground to provide support. The chair 10 may be assembled and positioned upside down to be used as a head rest for a user in a prone position. The separate chair portions may also be used as a solid surface for writing, drawing, eating, or any use requiring a rigid and strong surface.

The preferred dimensional length range of the portions 100 and 200 is between thirteen (13) inches and nineteen (19) inches with the preferred length being fourteen (14) inches. This is the preferred length as it fits within the height of a standard five-gallon bucket. The preferred width of the materials is ¾ of an inch to provide a solid and rigid structure of the chair 10. The chair 10 can be constructed out of varying materials that offer rigidity and strength, such as plastic, metal, wood, and laminated wood.

In an alternate embodiment of the present invention, the seat portion 100 and back portion 200 include a chamber within their height. This chamber acts as a storage compartment and allows the user to store small items within the chair seat portion 100 or the back portion 200. The chamber is integrated within the structure of the seat portion 100 or the back portion 200 and otherwise does protrude or add any additional bulk to the overall chair design.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) but that the invention will include all embodiments falling with the scope of the appended claims.

What is claimed is:

1. A portable and collapsible chair, the chair sized for receipt within a container, the chair comprising:

a back portion, the back portion having a tapered shape including:

a wide end; and a narrow end, the narrow end opposite the wide end; and a seat portion, the seat portion substantially planar with a width, the seat portion having:

a top side;

a bottom side, the bottom side opposite the top side;

a first end, the first end including an aperture, the aperture sized to receive the narrow end of the back portion, wherein the narrow end is frictionally received within the aperture and retained by the tapered shape of the back portion;

a second end, the second end opposite the first end; and a collar, the collar on the top side of the seat portion, the collar having a height extending upward from the top side opposite the bottom side and surrounding the aperture, wherein the collar supports the back portion when the back portion is received within the aperture.

2. A portable and collapsible chair as in claim 1, wherein the bottom side second end has a peg sized for receipt within an aperture on the wide end of the back portion.

3. A portable and collapsible chair as in claim 2, wherein the back portion and seat portion are connected with a tether.

4. A portable and collapsible chair, the chair sized for receipt within a standard five gallon bucket, comprising, in combination:

a five gallon bucket, the bucket having an open top, sidewall, and bottom wall;

a rigid back portion, the rigid back portion having a tapered shape sized for insertion into the bucket including:

a wide end, the wide end having a first aperture; and a narrow end, the narrow end opposite the wide end, the narrow end including a notch; and a rigid seat portion, the rigid seat portion substantially planar with a width, the rigid seat portion sized for insertion into the bucket, the rigid seat portion having:

a top side;

a bottom side, the bottom side opposite the top side, the bottom side having a peg, the peg sized to be received within the first aperture;

a first end, the first end including a second aperture, the second aperture sized to receive the narrow end of the back portion, wherein the narrow end is frictionally received within the aperture and retained by the tapered shape of the back portion;

a second end, the second end opposite the first end, the second having a second notch;

a rigid collar, the rigid collar on the top side and having a height extending upward opposite the bottom side and surrounding the aperture, wherein the rigid collar supports the back portion when received within the aperture; and a tether, the tether connecting the back portion and the seat portion.

* * * * *